US005745136A

United States Patent [19]

Saito

[11] Patent Number: 5,745,136

[45] Date of Patent: Apr. 28, 1998

[54] LIQUID JET HEAD, AND LIQUID JET APPARATUS THEREFOR

[75] Inventor: Asao Saito, Yokohama, Japan

[73] Assignee: Canon Kabushiki Kaishi, Tokyo, Japan

[21] Appl. No.: 772,062

[22] Filed: Dec. 19, 1996

Related U.S. Application Data

[63] Continuation of Ser. No. 229,221, Apr. 18, 1994, abandoned.

[30] Foreign Application Priority Data

Apr. 16, 1993 [JP] Japan ..... 5-090016

[51] Int. Cl.[6] ..... B41J 2/14; B41J 2/155

[52] U.S. Cl. ..... 347/50; 342/42; 342/45

[58] Field of Search ..... 347/42, 49, 50, 347/180

[56] References Cited

U.S. PATENT DOCUMENTS

| | | | |
|---|---|---|---|
| 3,813,513 | 5/1974 | Vora et al. . | |
| 4,429,321 | 1/1984 | Matsumoto . | |
| 4,458,256 | 7/1984 | Shirato . | |
| 4,571,602 | 2/1986 | De Schamphelaere et al. | 346/160 |
| 4,780,730 | 10/1988 | Dodge . | |
| 4,829,324 | 5/1989 | Drake et al. | 346/140 R |
| 4,947,191 | 8/1990 | Nozawa et al. | 346/140 R |
| 5,006,867 | 4/1991 | Koizumi et al. | 346/140 R |
| 5,016,023 | 5/1991 | Chan et al. | 347/50 |
| 5,030,971 | 7/1991 | Drake . | |
| 5,095,321 | 3/1992 | Saito et al. | 346/140 R |
| 5,157,419 | 10/1992 | Matsumoto et al. | 346/140 R |
| 5,160,945 | 11/1992 | Drake | 347/50 |
| 5,172,134 | 12/1992 | Kishida . | |
| 5,208,604 | 5/1993 | Watanabe et al. | 346/1.1 |
| 5,212,503 | 5/1993 | Saito et al. | 346/140 R |

FOREIGN PATENT DOCUMENTS

| | | |
|---|---|---|
| 0278075 | 8/1988 | European Pat. Off. . |
| 0307180 | 3/1989 | European Pat. Off. . |
| 0444763 | 9/1991 | European Pat. Off. . |
| 0532877 | 3/1993 | European Pat. Off. . |
| 57-72867 | 5/1982 | Japan . |
| 57-72868 | 5/1982 | Japan . |
| 1-232072 | 9/1989 | Japan . |
| 2059655 | 4/1981 | United Kingdom . |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

A liquid jet head for discharging liquid comprises a plurality of element boards each having electrothermal transducing elements to generate thermal energy for discharging liquid, and functional elements to drive the electrothermal transducing elements on one and the same board; and a circuit board having the wirings through which the functional elements input signals from or output signals to outside. Electrical connections are made so that the output signals from the element board are inputted to the adjacent element board through the circuit board. In this way, no connections are needed between chips in wire bonding to make the directions of bonding one-way, leading to a significantly increased efficiency of work on the wire connection. Also, with this structure, the adverse effect that would otherwise be produced on the element boards can be avoided in wire bonding, making it possible to miniaturize the element boards, and the head accordingly, and implement a highly densified nozzle arrangement for an elongated head.

8 Claims, 10 Drawing Sheets

LIQUID JET HEAD, AND LIQUID JET APPARATUS THEREFOR

This application is a continuation of application Ser. No. 08/229,221 filed Apr. 18, 1994, now abandoned.

BACKGROUND OF THE INVENTION

1. Field of the Invention

The present invention relates to a liquid jet recording head, and a liquid jet apparatus therefor. More particularly, the invention relates to an ink jet recording head which uses a base board for recording head, on which boards each having electrothermal transducing elements, driving transistors, shift registers, and other functional elements formed on one and the same board, and the ink jet apparatus therefor.

2. Related Background Art

In this respect, although the description is made using a recording ink as a liquid as described below, but the present invention is not limited thereto.

FIG. 10 is a perspective view showing a conventional ink jet recording head which uses a base board for the head.

On the element board 33 having the electrothermal transducing elements mounted on the board for discharging ink, a liquid chamber 82 in which ink flows, and a supply pipe 84 for supplying ink are formed in that order to constitute a recording head. Pads 85 formed on the element 33, and wiring patterns 87 formed on the board 32, such as an IC board and PCB 32, are electrically connected through bonding wires 38.

For an ink jet recording head such as this, the external signals are transmitted to the pads 85 on the board side through signal lines 87 and via the bonding wires 38. Ink is being supplied to the liquid chamber 82 through the ink supply pipe 84. The electrothermal transducing elements are driven by the external signals. Then, by the thermal energy generated at that time, ink is foamed to cause it to fly from nozzles 83 by the pressure exerted by the ink thus foamed.

FIG. 11 shows an example of the base board for a recording head used for an ink jet recording head. This base board for head has an aluminum plate as the base 41. On the base 41, there are arranged in given positions a board 44 for electrothermal transducing elements on which the electrothermal transducing elements are arranged in the form of alleys, an IC board 43 on which a transistor alley 46, latches 47, and shift registers 48, and other functional elements are formed on the same board, and a PCB 42 on which an input signal terminal 49 for receiving external signals, an output signal terminal 50 for outputting signals to the outside, and a power supply terminal 51 are arranged, respectively.

The conventional ink jet recording head which uses the base board for head of such a structure as above is arranged in such a manner as represented in a cross-sectional view shown in FIG. 12.

On the board 44 for the electrothermal transducing elements, a liquid chamber 52 in which ink flows, and a pipe 53 for supplying ink are formed in that order. The base board 44 for the electrothermal transducing elements, an IC board 43, a PCB 42 are electrically connected through bonding wires 45. Ink is discharged when the elements on the base board for the electrothermal transducing elements 44 are selectively energized.

In the recording head structured as above, the number of wires which electrically connect the element board with the outside are proportional to the number of electrothermal transducing elements. In general, the required number of wire bondings is as many as several hundreds. Such a requirement of wire bonding at many points tends to increase the occurrence of defects in assembling the system, thus resulting in the reduction of the product yield, and in the increased cost eventually. Therefore, in recent years, a recording head having the electrothermal transducing elements, the driving transistors, and other functional elements, which are assembled on one and the same board, has been developed as disclosed in Japanese Patent Laid-Open Application No. 57-72867 and Japanese Patent Laid-Open Application No. 57-72868, for example.

FIG. 13 is a view schematically showing the structure of such an element board for a head as having functional elements and electrothermal transducing elements formed on one and the same board.

The board for the recording head as shown in FIG. 13, which is structured in consideration of the above-mentioned problem, has a base 31 made of an aluminum plate as in the base board described earlier. On the base 31, there are provided in given positions, an element board 33 on which the electrothermal transducing element 34 arranged in an alley form, the functional elements for driving the electrothermal transducing elements 34, namely, the transistor alley 35, laches 36, and shift registers 37, are arranged together, and a PCB 32 on which an input signal terminal 39 for receiving signals from the outside, an output signal terminal 40 for outputting signals to the outside, and a power-supply terminal 41 are formed, respectively. Then the element board 33 and the PCB 32 are electrically connected through bonding wires 38.

In the above-mentioned structure, image signals are inputted from the outside to the input signal terminal 39 on the PCB 32. The image signals are transmitted to the shift registers 37, and then, stored in the latches 36. On the basis of the image signals, the transistor alley 35 is switched to control the current flowing to the electrothermal transducing elements 34 which are connected to the transistors 37. At this juncture, the current supply to the electrothermal transducing elements 34 is made externally through the power-supply terminal 41. In this respect, no GND terminal is represented among those elements shown in FIG. 13.

By use of the base board for head having the driving elements and the electrothermal transducing elements formed on one and the same board as described above, it is possible to avoid the reduction of the product yield which is caused by the defective assembly due to the provision of as many numbers of wire bondings as several hundreds. However, since the transistors, shift registers, and other functional elements are formed on the same board where the electrothermal transducing elements are formed, the yield of the board process will be the product of each of the yields of the functional elements and the electrothermal transducing elements. As a result, if the head should be more elongated, more numbers of electrothermal transducing elements, transistors, shift registers, and latches are necessarily increased accordingly, hence still reducing the yield of the board process, and creating a great problem.

Regarding the yield of these elements, various studies have been made, and it is known that the yield can be simulated by use of an exponential function such as Poisson's model. According to such a simulation, it is found that if the number of bits is doubled, for example, the original yield of 80% is reduced to as low as 50% or less.

With this in view, when an elongated head is fabricated with the element board on which the shift registers, latches, and other functional elements are assembled, a plurality of smaller element boards are arranged to form one elongated head instead of preparing an elongated element board with only one board.

FIG. 14 shows an example of such boards for an elongated head.

Here, the represented example has three element boards 1003 which are arranged in line to configure an elongated head. A reference numeral 1005 designates each region where the electrothermal transducing elements are arranged for each of the boards. The element boards are connected with each other via electrode pads 1004 by means of wire bonding and others.

FIG. 15 shows the arrangement of elements on each of the element boards which constitute the board for the elongated head shown in FIG. 14.

A reference numeral 1025 designates the region where the latches, shift registers, and functional elements are arranged to convert the serial image data inputted to the element board to the parallel signals for each of the electrothermal transducing elements; 1015, the functional elements which control the currant to be applied to the electrothermal transducing elements. With the functional elements 1015 for control, the voltage is applied to the selected electrothermal transducing elements 1005 through the common electrodes 1014 on the voltage supply side.

In the board for an elongated head such as above, signals are transmitted through each of the element boards by connecting each of the pads with the wire bonding and others.

However, in the mode in which the element boards are connected with each other as described above, there are still problems given below. These are the subjects which should be solved.

The element boards themselves are electrically connected with the wire bonding and others. In connecting these boards by wires made of Au or the like, a great force is exerted on the board when one end of the wires is connected. Therefore, if the wires should be connected to the element boards on both sides, there is a possibility that the element boards are damaged.

Meanwhile, in developing heads, it is desired that not only the head should be elongated, but also the head should be miniaturized, and a highly densified arrangement of nozzles should be implemented. As a result, the intervals between the elements boards must be narrowed in order to arrange the element boards in line to agree with the intended nozzle pitches. However, whereas the electrothermal transducing elements should be arranged at pitches of 70 μm to obtain a high density, at least approximately 300 μm is needed as an interval between connecting points when the elements boards are connected by use of wire bonding. Therefore, it is difficult to arrange the boards to satisfy the narrower pitches as required. Also, if the pads are provided in a position other than the end portions of each board in order to implement this type of narrower connection, the size of the element board should be made larger or there is a possibility that elements on the element boards are damaged.

SUMMARY OF THE INVENTION

The present invention is designed to solve the above-mentioned problems. It is an object of the invention to provide a liquid jet head for which an elongation is attempted by arranging a plurality of element boards each having the functional elements and the electrothermal transducing elements formed on one and the same board, and the element boards are compactly connected electrically in an excellent condition.

The main aspects of the present invention are as follows:

a liquid jet head comprising:

a plurality of element boards each having the electrothermal transducing elements which generate thermal energy for discharging liquid, and the functional elements for driving the electrothermal transducing elements on one and the same board; and a circuit board for installing the wires for the functional elements to input signals from and output signals the outside, and the electrical connections are arranged so that the output signals from an element board are inputted into an adjacent element board through the circuit board.

Also, a head cartridge and a liquid jet apparatus for which this head is used.

DETAILED DESCRIPTION OF THE PREFERRED EMBODIMENTS

Hereinafter, with reference to the accompanying drawings, the description will be made of the embodiments according to the present invention.

Figure 1:
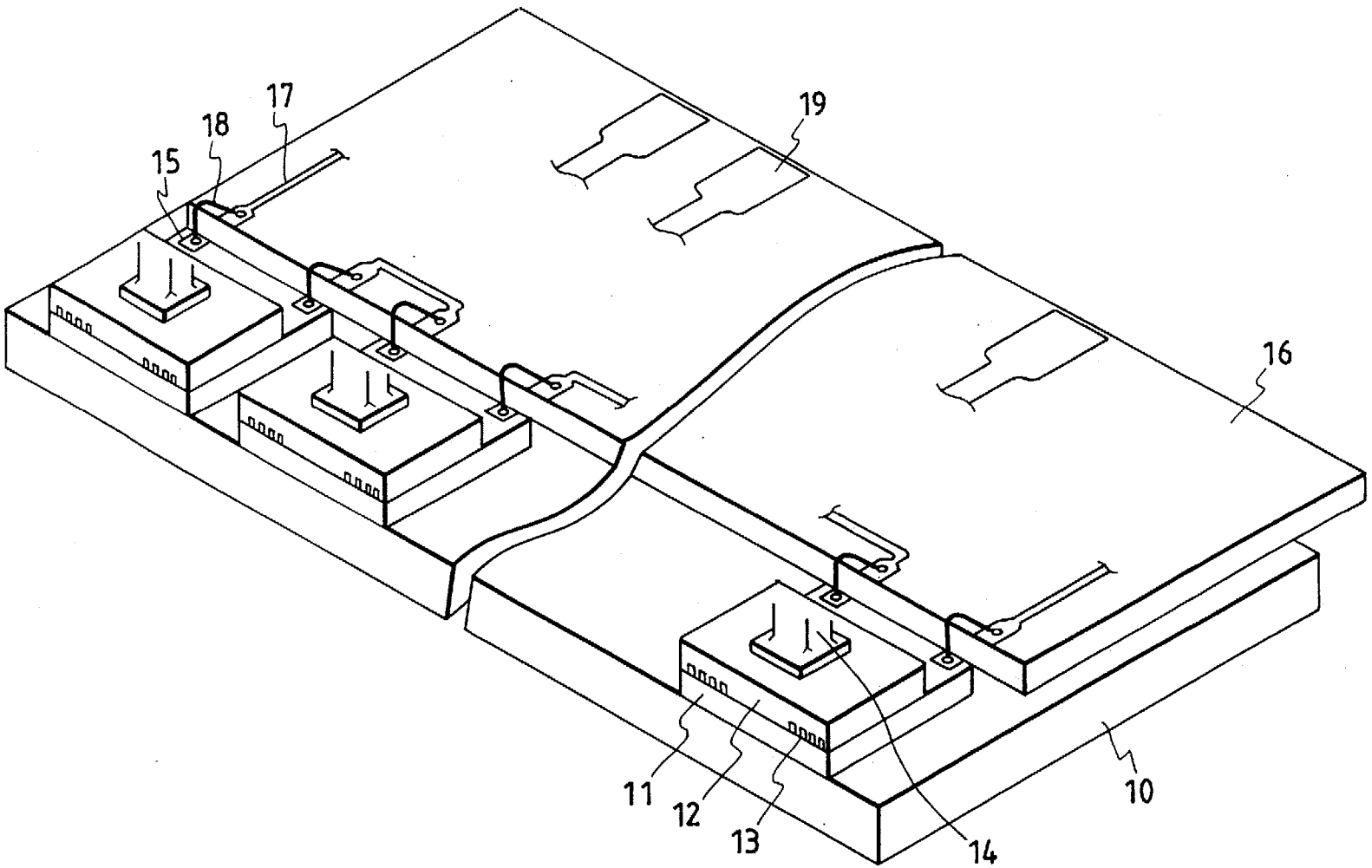
FIG. 1 is a perspective view showing the structure of an embodiment of an ink jet recording head according to the present invention.

FIG. 1 is a perspective view showing the structure of an embodiment of an ink jet recording head according to the present invention.

As shown in FIG. 1, the ink jet recording head according to the present invention has a base board 10 made of an aluminum plate. On the upper surface of the aluminum plate base board 10, a plurality of element boards 11 are aligned on one end of the base board 10. Also, these boards are arranged so that the discharging directions thereof are identical, and at the same time, a PCB 16 is arranged with signal terminals 19 formed on it to transmit signals to or receive them from wiring patterns 17 or outside. The element boards 11 and the PCB 16 which serves as the circuit board are electrically connected through the pads 15 and bonding wires 18 which are arranged on the element boards 11. Each of the element boards 11 is formed with a plurality of electrothermal transducing elements and the functional elements for them thereon together. On the element board 11, a liquid chamber 12 having nozzles 13, and an ink supply pipe 14 to supply ink are formed in that order. Ink is supplied to the interior of the chamber through the supply pipe 14. The functional elements and the electrothermal transducing elements on the element board 11 are driven through the signal terminals 19 on the PCB board 16. The ink is expanded by the thermal energy generated by the electrothermal transducing elements, are thus discharged from the nozzles 13.

Figure 2:
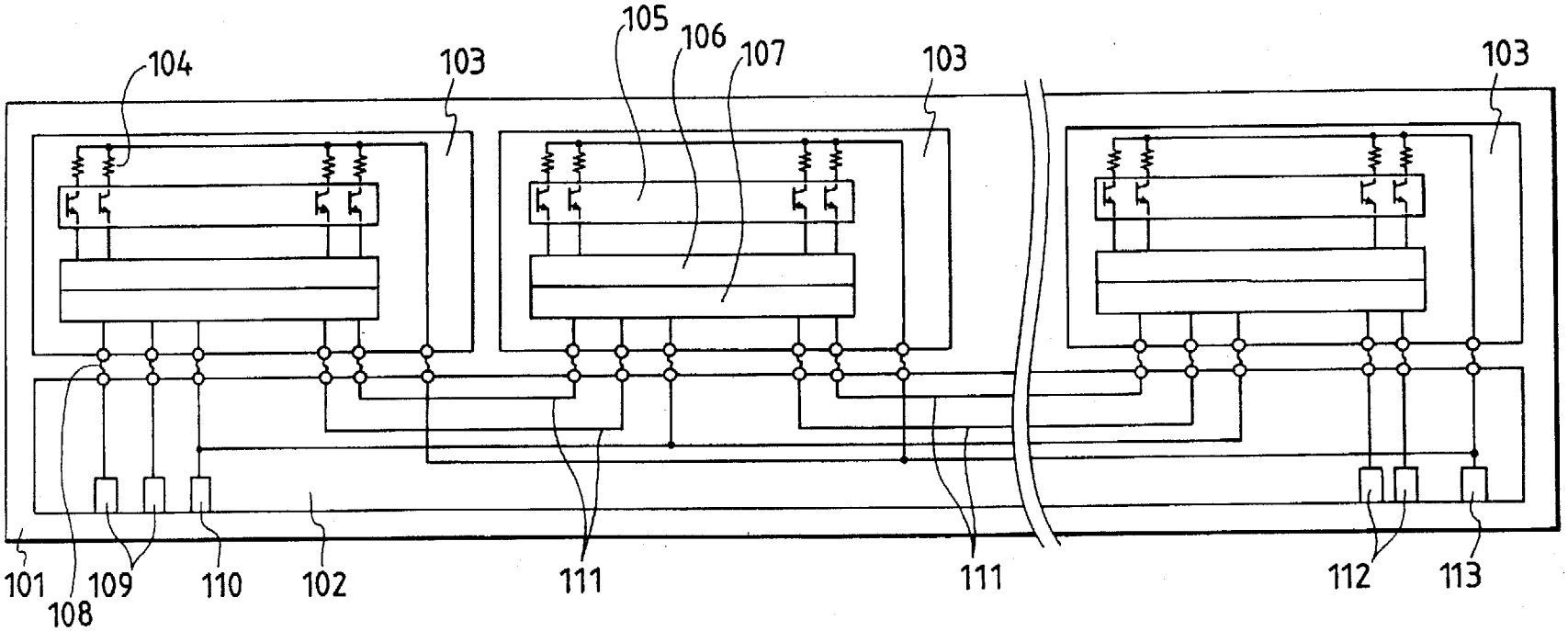
FIG. 2 is a view schematically showing the structure of a base board for head to be used for an embodiment of an ink jet recording head according to the present invention.

FIG. 2 is a view schematically showing the structure of the base board for head used for an embodiment of an ink jet recording head according to the present invention.

The base board for a recording head shown in FIG. 2 has a base 101 made of an aluminum plate. On the base 101, there are arranged in given positions the electrothermal transducing elements 104 arranged in an alley form, and a plurality of element boards 103 each having the functional elements, namely, a transistor alley 105, latches 106, and shift registers 107, are formed thereon to drive the electrothermal transducing elements 104, and a PCB 102 on which an input signal terminal 110 to input signals from the outside, an output signal terminal 112 to output signals to the outside, a power-supply terminal 113, and wiring patterns 111 are formed, respectively. Then the element boards 103 and the PCB 102 are electrically connected through bonding wires 108.

With the above-mentioned structure, image signals are inputted from the outside to the input signal terminals 109 and 110 on the PCB board 102. The image signals are transmitted to the shift registers 107 through the bonding wires 108, and then, stored in the latches 106. On the basis of the image signals thus stored, the transistor alley 105 is switched to control the current flowing to the electrothermal transducing elements 104 connected to the transistors. At this juncture, the current is supplied from the outside to the electrothermal transducing elements 104 through the power supply terminal 113. Also, the functional elements on each of the element boards 103 themselves are connected through the wiring patterns 111 on the PCB 102 so that output signals from the element boards 103 on the front stage can be input signals to the element board 103 on the next stage. In this way, the shift registers 107 on each of the element boards 103 are serially connected. It is of course possible to input the image signals such as printing data in series per functional element in order to drive each of the electrothermal transducing elements, but a connection of the kind results in the increased number of signals lines. Here, therefore, a serial connection is adopted in consideration of the advantages to be gained in assembling the boards. In this respect, any elements other than the functional ones required to drive the electrothermal transducing elements, such as a temperature sensor, are not shown in FIG. 2. Also, no GND terminal is shown, but it would be known by those skilled in the art that such elements can be designed using a conventional lay out.

In an invention of the kind, adjacent element boards themselves are connected through wiring patterns 111 on a PCB 102.

Therefore, when the element boards and wires are connected, the connections are made on the side where no load is exerted on the boards, and then, the connections on the side where a load is exerted are made after the wires and the PCB are connected. Thus there is no possibility that the element boards are damaged. Also, no pads for electrical connection are needed on both ends of each element board, hence making it possible to miniaturize the elements boards. Further, a plurality of element boards can be arranged and connected electrically while maintaining the pitches of the elements for generating heat resistance on each of the element boards.

Particularly, for the element boards each having functional elements for converting data, such as shift registers and latches, which receive the serial image data from the outside and convert them to the parallel data which are transmitted to the electrothermal transducing element side for the corresponding electrothermal transducing elements, it is preferable to connect the element boards themselves directly from the viewpoint of data transfer as described ealier in the Related Background Art. Nevertheless, if these element boards should purposely be connected through the PCB, such effect as mentioned above can be obtained.

Also, according to the present invention, the height of the pads for connecting the PCB and each of the element boards is arranged to be on the same level, but it should be good enough if only the heights of pads on the PCB and those on the element boards are the same or the heights of the pads on the PCB are lower. However, the difference in height should preferably be maintained within 1.7 mm or less.

Figure 3:
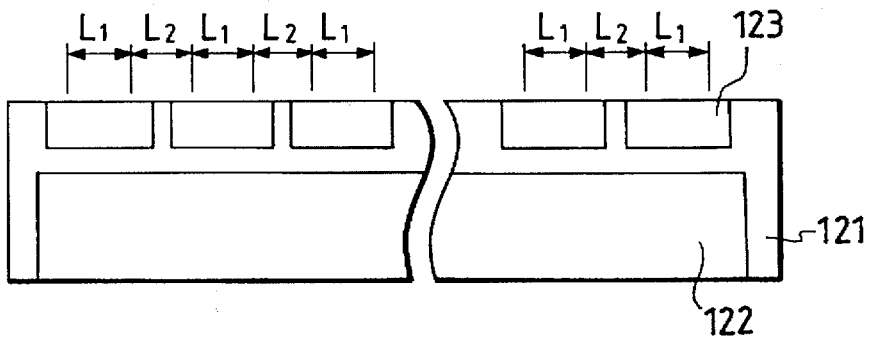
FIG. 3 is a view showing the arrangement dimensions of an element board for an embodiment of an ink jet recording head according to the present invention.

Now, the description will be made of the arrangement of the above-mentioned element boards on the base board. FIG. 3 is a view showing the dimensions in which element boards are arranged for an embodiment of an ink jet recording head according to the present invention.

In the same manner as described above, a plurality of element boards 123 and a PCB 112 are arranged on a base board 121 as shown in FIG. 3. The length of arrangement is defined as $L_1$ for a first nozzle to the nth nozzle for each of the element boards 123, respectively. The interval between the element boards is defined as $L_2$ by the interval between the nozzles arranged on end portions.

Subsequently, the description will be made of a printing operation by use of the above-mentioned recording head.

Figure 4:
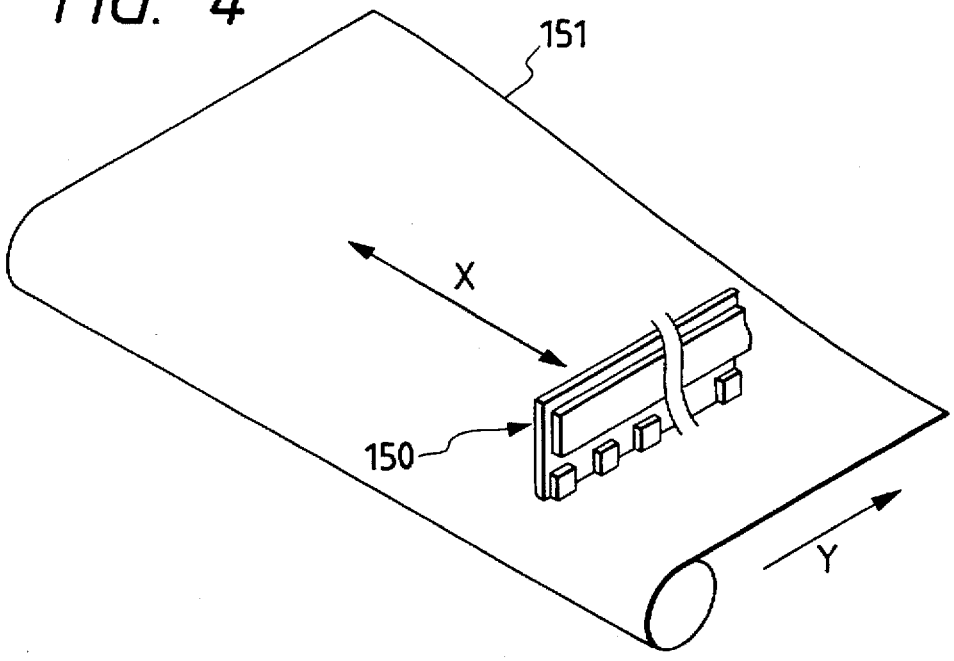
FIG. 4 is a view schematically showing an operation of printing when using an embodiment of an ink jet recording head according to the present invention.

FIG. 4 is a view schematically showing a printing operation by use of an embodiment of an ink jet recording head according to the present invention.

As shown in FIG. 4, the direction in which a printing sheet 151 is fed is defined as the main scanning direction (direction Y). The direction orthogonal to this direction is defined as the sub-scanning direction, which is the direction X in FIG. 4. The ink jet recording head is arranged to scan in the directions thus defined. Here, the element boards on the base board made of aluminum plate are arranged in the direction Y. In a monochromatic printer, if the arrangement and the scanning directions are set as above, the entire nozzles can be driven if the relationship between the dimensions $L_1$ and $L_2$ shown in FIG. 3 is defined as $L_1 = L_2$, and the feed amount of the sheet is defined as $L_1(=L_2)$, thus making it possible to enhance the ability of printing process.

Also, when using a color printer which utilizes several kinds of ink, there is no need for making the $L_1$, and $L_2$ equal.

Here, by arranging a plurality of element boards on the base board to make the value of the aforesaid $L_2$ equal to the value of the nozzle pitch, the entire nozzles of the ink jet recording head formed by the element boards are in a same pitch. As a result, it becomes unnecessary to execute any complicated control on the sheet feeding, hence making a higher printing possible.

Figure 5:
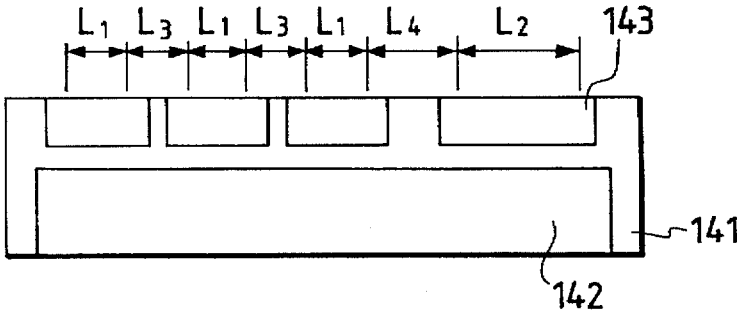
FIG. 5 is a view showing the arrangement dimensions of the element board when an ink jet recording head of the present invention is used as a color printer.

FIG. 5 is a view showing the dimensions of the arrangement of the element boards for an ink jet recording head of the present invention to be used for a color printer.

As shown in FIG. 5, a plurality of element boards 143 and a PCB 142 are arranged on a base board 141. For a color printer, the intervals $L_3$ and $L_4$ for the arrangement of the element boards themselves, and the lengths $L_1$ and $L_2$ for the arrangement of nozzles can be made different from each other.

Figure 6:
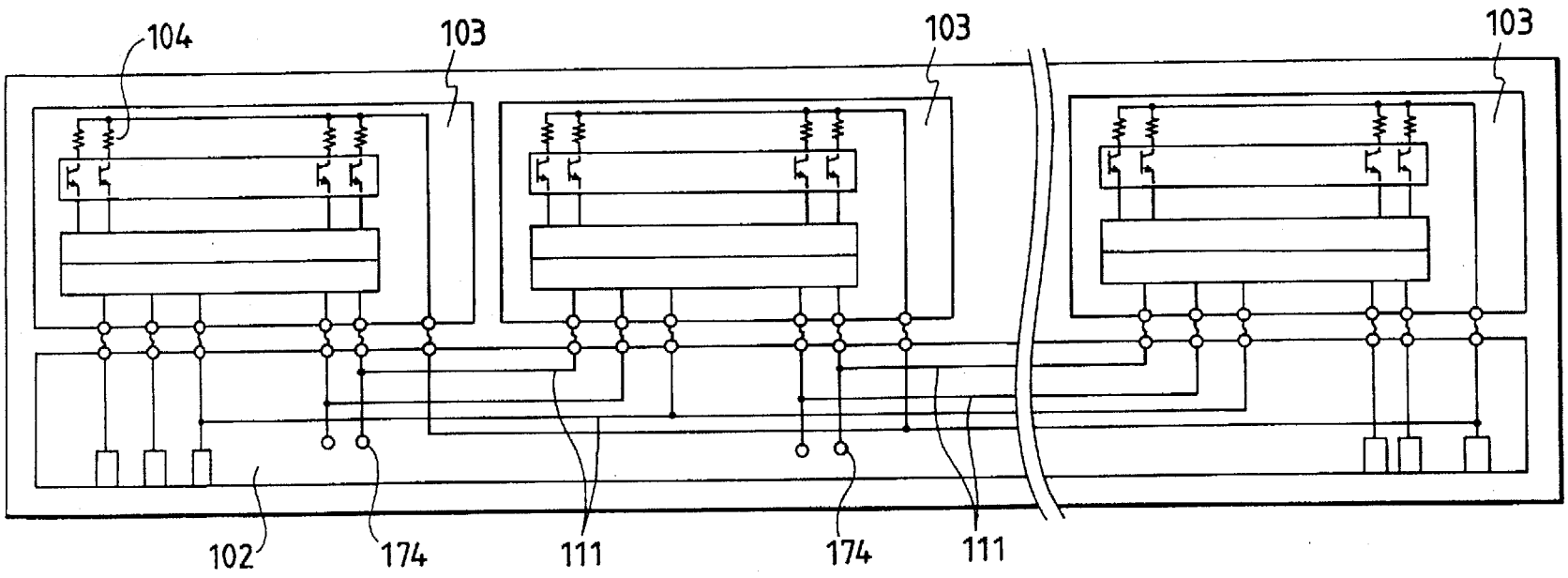
FIG. 6 is a view schematically showing the structure in which a pattern for electrical inspection is provided for the board for head shown in FIG. 2.

Conceivably, a pattern for conducting electrical inspections can be added to the structure shown in FIG. 2. FIG. 6 is a view schematically showing a structure in which a pattern for conducting electrical inspections is added to the board for a head shown in FIG. 2. In addition to the structure shown in FIG. 2, a pattern 174 for conducting electrical inspections is provided each for the wiring patterns 111 formed on the PCB 102 to serially connect each of the functional elements 103 themselves as shown in FIG. 6. By providing the pattern for conducting electrical inspection such as above, an inspection is possible to find a defective element when the functional elements are found defective in the structure in which many numbers of element boards 103 are connected serially. The number of defective products can be reduced by inspecting the assembled heads, and if any defect is found in a head, such a particular head can be modified just by replacing a defective block thus found by the inspection.

Figure 7:
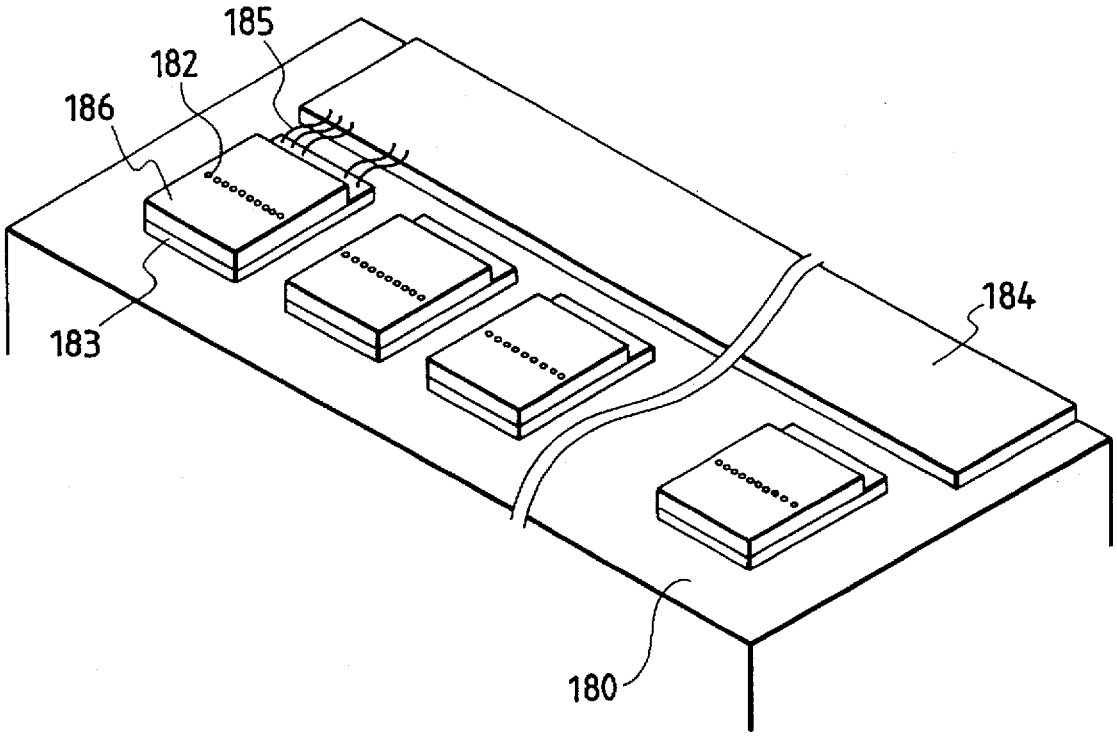
FIG. 7 is a perspective view schematically showing another embodiment of an ink jet recording head according to the present invention.

FIG. 7 is a perspective view schematically showing the structure of an embodiment of an ink jet recording head according to the present invention.

In an ink jet recording head according to the present embodiment, a plurality of element boards 183, and a PCB 184 are arranged in given positions on a base board 180 as shown in FIG. 7. The PCB 184 and each of the element boards 183 are connected electrically by bonding wires 185. On each of the element boards 183, a liquid chamber 186 is formed. On the upper surface of the chamber 186, nozzle apertures 182 are arranged for discharging ink. This is the so-called side shooter structure.

A hole is penetratingly provided through the element board 183 and the base board 180 in order to supply ink to the chamber 186 from an ink tank arranged in the base board 186.

In the above-mentioned embodiment, although a structure in which each of the element boards is connected to the PCB by wire bonding, the present invention is not limited to such a structure. A TAB type, that is, a wireless bonding using a film, a type in which a conductive member is press bonded, or any other method will do if only the boards are electrically connected satisfactorily.

Also, according to the above-mentioned embodiment, the shift registers are formed on the element board as a functional element, but the present invention is not limited thereto. It is possible to anticipate the increased yield by use of a diode matrix board. Now, the use of the diode matrix board will be described.

Figure 8:
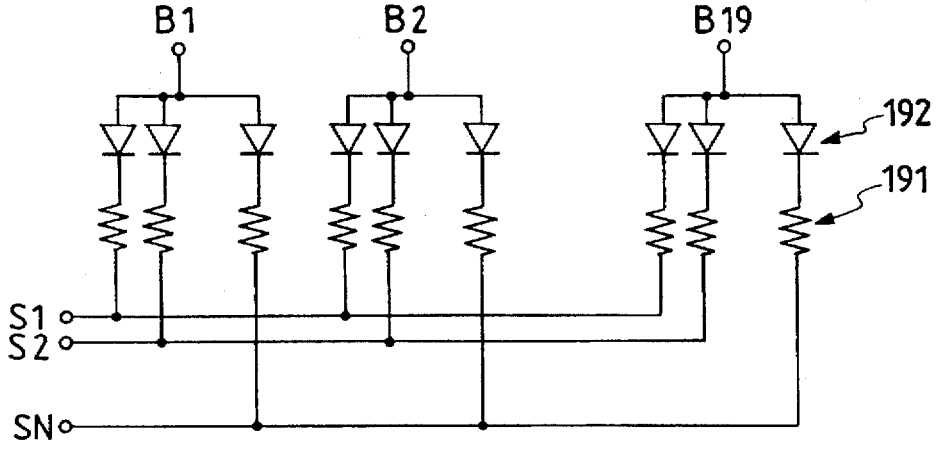
FIG. 8 is a view schematically showing the structure of another variation of the element board for an ink jet recording head according to the present invention.

FIG. 8 is a view schematically showing the structure of another example of the variation of the element board for an ink jet recording head according to the present invention.

On a diode matrix board, the electrothermal transducing elements 191 and diodes 192 are connected in series, respectively, in each of N numbers of segments (S), which are arranged in parallel in M numbers of blocks (B) as shown in FIG. 8. The current which flows to each of the electrothermal transducing elements 191, respectively, is controlled by switching the application of current between the blocks M and Segments N arbitrarily. A recording head having a diode matrix board such as above can be manufactured without lowering the yield of the board process in the same way as the present embodiment.

Figure 9:
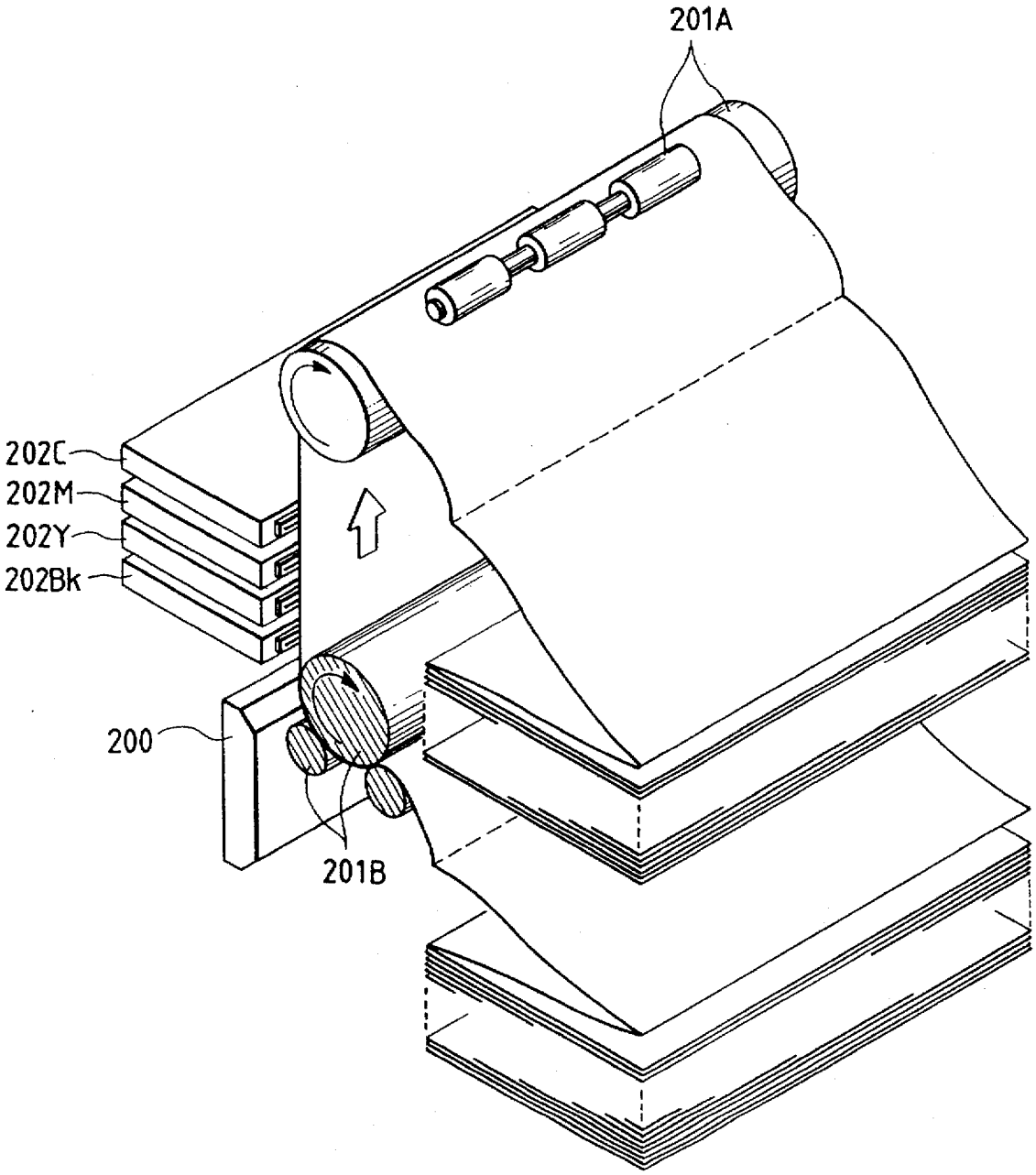
FIG. 9 is a view showing a recording apparatus for which a head of the present invention is used.
Figure 10:
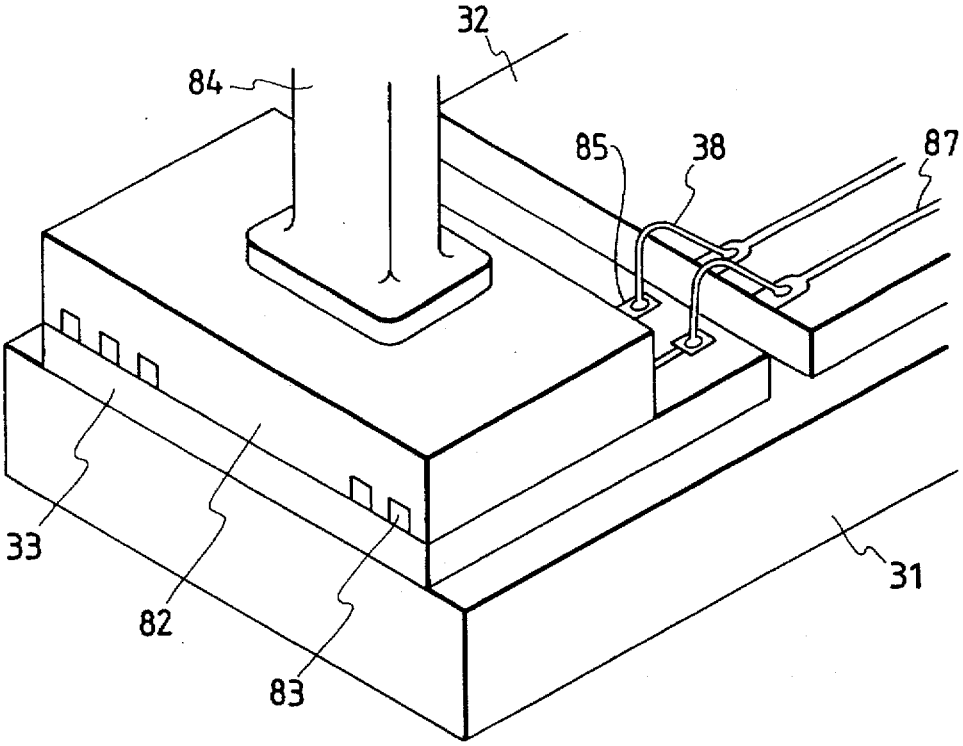
FIG. 10 is a view schematically showing a liquid jet head.
Figure 11:
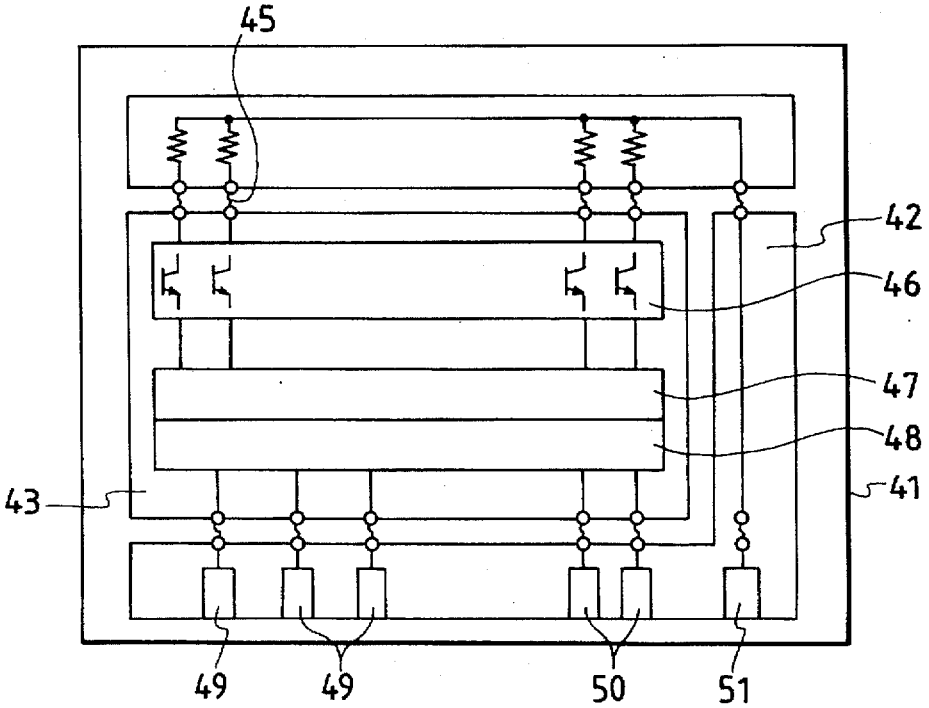
FIG. 11 is a view schematically showing the structure of a board for a recording head.
Figure 12:
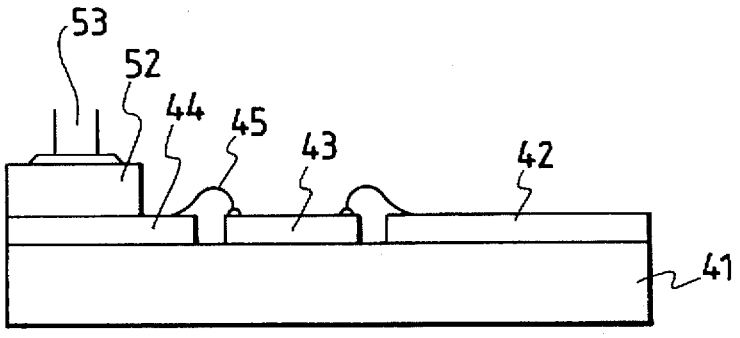
FIG. 12 is a side view showing a recording head.
Figure 13:
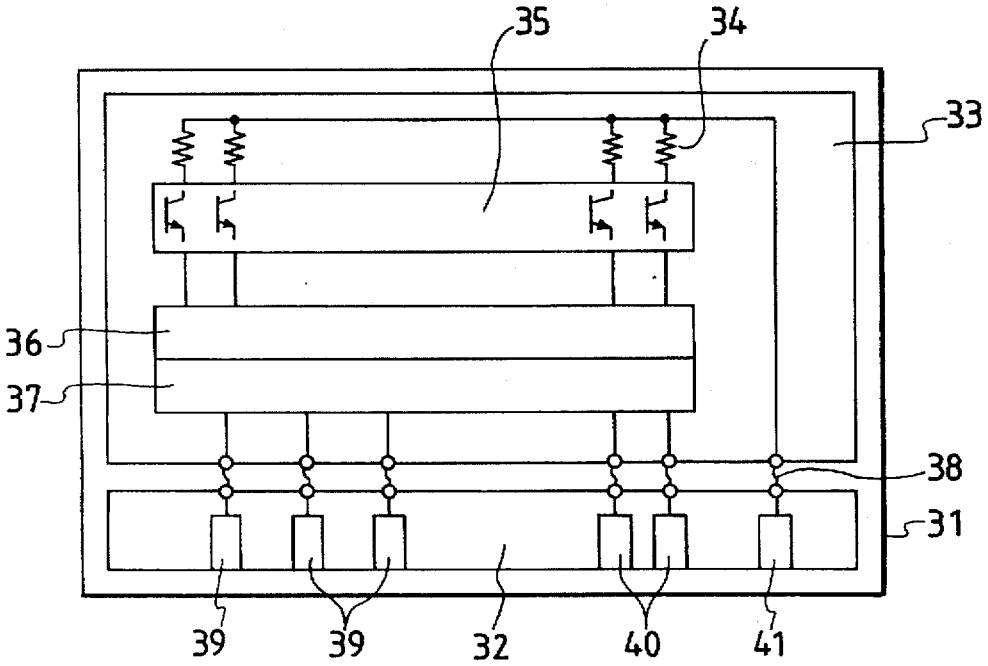
FIG. 13 is a view showing the structure of a board for head.
Figure 14:
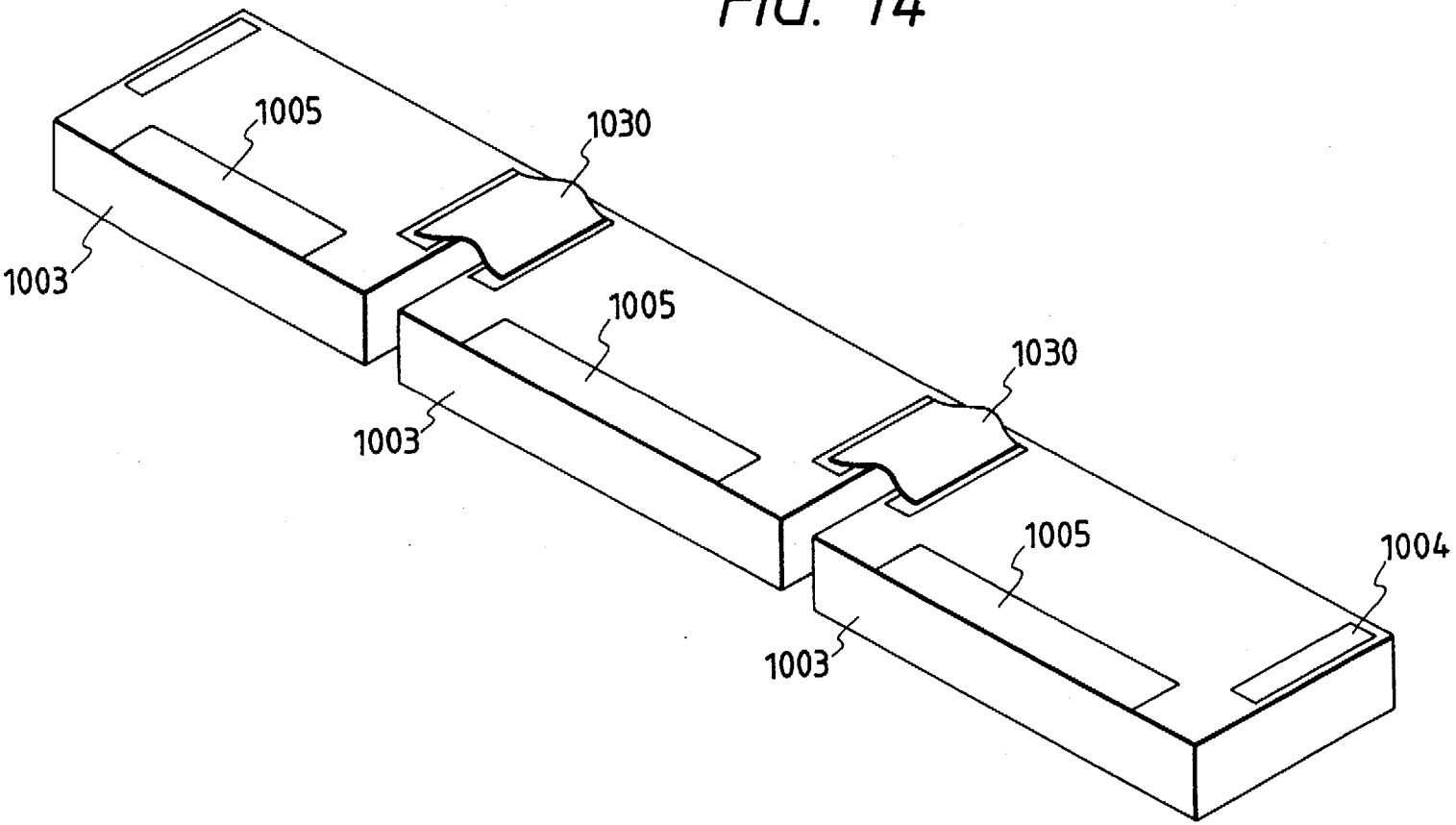
FIG. 14 is a view illustrating the mode of a head in which a plurality of element boards are connected.
Figure 15:
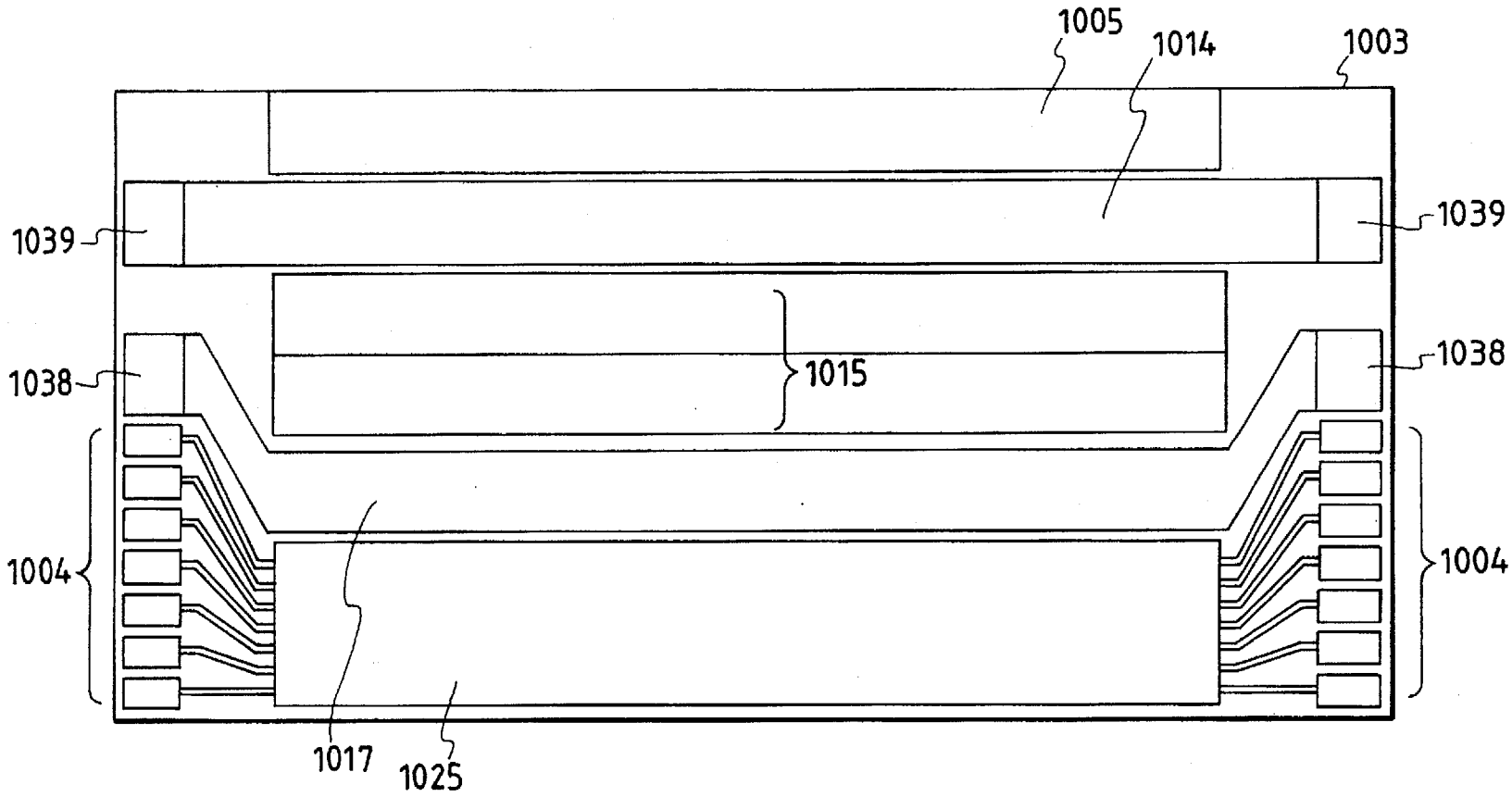
FIG. 15 is a view illustrating an element board.

FIG. 9 illustrates a high quality full color recording apparatus in which a full line liquid jet recording device is arranged by structually providing a recording element, functional element, and driving element on one and the same board. This arrangement serves as if several tens of corresponding semi-conductor chips are provided. Four of such full line device are arranged for cyan, yellow, magenta, and black, respectively. Reference numerals 201A and 201B designate a pair of rollers provided for pinching a recording medium R to feed it in the sub-scanning direction $V_s$, and 202BK, 202Y, 202M, and 202C designate the full line type recording devices having the arrangement of nozzles over the entire width of the recording medium R for recording in black, yellow, magenta, and cyan, respectively. These devices are arranged in order of black, yellow, magenta, and cyan in the feeding direction of the recording medium from the upstread side, thus constituting an aggregate of recording devices. A reference numeral 200 designates means for recovering discharge, which faces the aggregate of the recording devices in place of the recording medium R when a discharge recovery process is executed. This means for discharge recovery includes caps, ink adsorbents, wiping blades, and others.

In this respect, the description has been made in the above-mentioned embodiment that each of the functional elements and electrothermal transducing elements are arranged on each of the element boards. Here, the expression "on the element board" means to indicate the surface of the board, on the surface thereof, in the interior thereof and some others.

As described above, the present invention will produce effects as given below.

A recording head is arranged separately on a plurality of elements boards, and each of the elements boards is arranged on one and the same base board. The board for a recording head, on which the functional elements and electrothermal transducing elements are formed together on it, can be manufactured without lowering the process yield. At the same time, it becomes possible to provide many nozzles for the heads for recording in colors, thus implementing the cost reduction of recording heads.

Further, the element boards themselves can be connected through a circuit board arranged on the same base board. Hence, there is no need for connecting chips in wire bonding. The bonding directions can be arranged in one-way, thus making it possible to make the work on the wire connection more efficient. Also, it is possible to avoid any adverse effects to be produced on the element boards in wire bonding because the boards are connected so that signals output form the board for recording head in the front stage can be signals to be inputted into the board for recording head on the following stage through the circuit board. Also, the element boards and the head can be miniaturized. At the same time, the nozzles can be arranged in a high density in an elongated head.

What is claimed is:

1. A liquid jet head for discharging a liquid, comprising:

discharging means for discharging the liquid;

a support member having an end portion;

a plurality of element boards provided in an array at the end portion of the support member, each of said element boards having a plurality of electrothermal transducing elements to generate thermal energy for discharging the liquid, and a plurality of functional elements to drive said electrothermal transducing elements; and a circuit board provided on said support member juxtaposed to and alone said array of said element boards, said circuit board having a plurality of wirings which transmit a signal outputted from a particular said functional element of a particular said element board to a particular said functional element of an given said element board which is adjacent to said particular element board, wherein plurality of electrical connections which are made so that the output signal from said element boards is inputted to an adjacent said element board through said circuit board.

2. A liquid jet head according to claim 1, wherein said liquid is ink.

3. A liquid jet head according to claim 1, wherein said functional elements receive serial image signals from outside the circuit board and said functional elements output a plurality of parallel image signals to an electrothermal transducing element side of said circuit board.

4. A liquid jet head according to claim 1, wherein said element boards and said circuit board are electrically connected at an element board height and a circuit board height, respectively, such that said element board height is at least as high as high as said circuit board height.

5. A liquid jet apparatus for recording by discharging a liquid, comprising:

a liquid jet head for discharging the liquid, having discharging means for discharging the liquid;

a support member having an end portion;

a plurality of element boards provided in an array at the end portion of the support member, each of said element boards having a plurality of electrothermal transducing elements to generate thermal energy for discharging the liquid, and a plurality of functional elements to drive said electrothermal transducing elements; and a circuit board provided on said support member juxtaposed to and along said array of said element boards, said circuit board having a plurality of wirings which transmit a signal outputted from a particular said functional element of a particular said element board to a particular said functional element of a given said element board which is adjacent to said particular element board; and feeding means for feeding a recording medium for receiving the liquid.

6. A liquid jet apparatus as in claim 5, wherein the liquid is an ink.

7. A liquid jet apparatus for recording by discharging a liquid, comprising:

a liquid jet head for discharging a liquid, having discharging means for discharging the liquid;

a support member having an end portion;

a plurality of element boards provided in an array at the end portion of the support member, each of said element boards having a plurality of electrothermal transducing elements to generate thermal energy for discharging the liquid, and a plurality of functional elements to drive said electrothermal transducing elements; and a circuit board provided on said support member juxtaposed to and along said array of said element boards, said circuit board having a plurality of wirings which transmit a signal outputted from a particular said functional element of a particular said element board to a particular said functional element of a given said element board which is adjacent to said particular element board; and feeding means for feeding a recording medium, for receiving the liquid, wherein said functional elements receive a plurality of serial image signals from outside the circuit boards and output a plurality of parallel image signals to an electrothermal transducing element side of said circuit boards.

8. A liquid jet apparatus as in claim 7, wherein the liquid is an ink.

* * * * *

UNITED STATES PATENT AND TRADEMARK OFFICE

CERTIFICATE OF CORRECTION

PATENT NO. : 5,745,136

DATED : April 28, 1998

INVENTOR(S) : ASAO SAITO

It is certified that error appears in the above-identified patent and that said Letters Patent is hereby corrected as shown below:

ON COVER PAGE AT [73] ASSIGNEE

"Canon Kabushiki Kaishi" should read --Canon Kabushiki Kaisha--.

ON COVER PAGE AT [56] REFERENCES CITED, U.S. PATENT DOCUMENTS

Insert --5,175,565 12/1992 Ishinaga et al. 346/140R--.

COLUMN 2

Line 25, "laches 36," should read --latches 36,--.

COLUMN 3

Line 21, "1015, the functional elements which" should read --functional elements 1015--;
Line 22, "currant" should read --current--;
Line 47, "elements" should read --element--; and
Line 52, "elements" should read --element--.

COLUMN 4

Line 12, "signals the" should read --signals to the--.

COLUMN 5

Line 22, "are" should read --and--.

UNITED STATES PATENT AND TRADEMARK OFFICE

CERTIFICATE OF CORRECTION

PATENT NO. : 5,745,136

DATED : April 28, 1998

INVENTOR(S) : ASAO SAITO

It is certified that error appears in the above-identified patent and that said Letters Patent is hereby corrected as shown below:

COLUMN 6

Line 4, "the" should read --this--; and
Line 14, "elements" should read --element--.

COLUMN 7

Line 2, "$L_1$," should read --$L_1$--; and
Line 53, "186." should read --180.--.

COLUMN 8

Line 11, "Segments N" should read --segments N--;
Line 20, "semi-conductor" should read --semiconductor--;
Line 21, "device" should read --devices--;
Line 31, "upstread" should read --upstream--;
Line 48, "elements" should read --element-- (both occurrences); and
Line 64, "form" should read --from--.

UNITED STATES PATENT AND TRADEMARK OFFICE

CERTIFICATE OF CORRECTION

PATENT NO. : 5,745,136

DATED : April 28, 1998

INVENTOR(S) : ASAO SAITO

It is certified that error appears in the above-identified patent and that said Letters Patent is hereby corrected as shown below:

COLUMN 9

Line 16, "alone" should read --along--;
Line 20, "an" should read --a--;
Line 24, "plurality" should read --a plurality--; and
Line 39, "as high" (second occurrence) should be deleted.

Signed and Sealed this

Twentieth Day of July, 1999

*Attest:*

*Attesting Officer*

Q. TODD DICKINSON

*Acting Commissioner of Patents and Trademarks*